US008826797B2

(12) United States Patent
Overstreet et al.

(10) Patent No.: US 8,826,797 B2
(45) Date of Patent: Sep. 9, 2014

(54) MODIFIABLE UPPER RECEIVER FOR M-16/AR15 TYPE FIREARM IN PARTICULAR FOR ADAPTING TO SPECIFIC NEEDS OF RIGHT AND LEFT HANDED SHOOTERS

(75) Inventors: John L. Overstreet, Fayette, MO (US); Jordan Bowles, Columbia, MO (US)

(73) Assignee: 22 Evolution LLC, Columbia, MO (US)

( * ) Notice: Subject to any disclaimer, the term of this patent is extended or adjusted under 35 U.S.C. 154(b) by 49 days.

(21) Appl. No.: 13/345,797

(22) Filed: Jan. 9, 2012

(65) Prior Publication Data

US 2012/0174451 A1 Jul. 12, 2012

Related U.S. Application Data

(60) Provisional application No. 61/431,248, filed on Jan. 10, 2011.

(51) Int. Cl.

| | |
|---|---|
| ***F41A 3/00*** | (2006.01) |
| ***F41C 7/00*** | (2006.01) |
| ***F41A 35/06*** | (2006.01) |
| ***F41A 3/12*** | (2006.01) |

(52) U.S. Cl.
CPC .. *F41A 35/06* (2013.01); *F41A 3/12* (2013.01)
USPC ..... 89/128

(58) Field of Classification Search
CPC ..... F41A 35/06; F41A 3/12
USPC ..... 42/75.03, 98; 89/9, 125, 128
See application file for complete search history.

(56) References Cited

U.S. PATENT DOCUMENTS

| | | | | |
|---|---|---|---|---|
| 3,030,723 | A * | 4/1962 | Ivy | 42/65 |
| 3,603,015 | A * | 9/1971 | Jensen | 42/98 |
| 3,952,440 | A * | 4/1976 | Tellie | 42/106 |
| 6,523,293 | B2 * | 2/2003 | Murello et al. | 42/25 |
| 6,925,744 | B2 | 8/2005 | Kincel | |
| 7,937,870 | B2 | 5/2011 | Brown | |
| 8,117,954 | B1 | 2/2012 | Davis | |
| 2006/0156606 | A1 | 7/2006 | Robinson et al. | |
| 2007/0199435 | A1 * | 8/2007 | Hochstrate et al. | 89/191.02 |
| 2010/0000396 | A1 * | 1/2010 | Brown | 89/1.4 |
| 2011/0174139 | A1 | 7/2011 | Olsen et al. | |
| 2012/0167433 | A1 | 7/2012 | Robbins et al. | |

OTHER PUBLICATIONS

John M et al., AR15 Upper Receiver Comparison and FAQ, Aug. 27, 2000, http://www.biggerhammer.net, pp. 1, 4, and 8.*

Andrew Price, M4 Carbine—Work in Progress, Apr. 7, 2009, p. 1.*

Website information from http://www.vltor.com/mur.htm printed Sep. 13, 2012 at 7:46AM, titled MUR (Modular Upper Receiver), [Products] [Handguards and Rail Systems], [See Pictures—Click Here] (pictures of which are printed and attached) (7 pages total).

* cited by examiner

*Primary Examiner* — Stephen M Johnson
*Assistant Examiner* — Benjamin Gomberg
(74) *Attorney, Agent, or Firm* — Gifford, Krass, Sprinkle, Anderson & Citkowski, P.C.; Douglas J. McEvoy

(57) ABSTRACT

A modularized upper receiver including any number of replaceable panels applied to either the left or right side of the receiver for establishing varying combinations of forward assist and spent shell/gas deflection. The modifiable upper receiver is particularly suited to ambidextrous use and, in the further instance of forward assist notches added to an opposite side of the carrier, prevents the shooter from removing such as the right hand from the pistol grip in order to force feed rounds into the firing chamber.

5 Claims, 7 Drawing Sheets

FIG. 4A
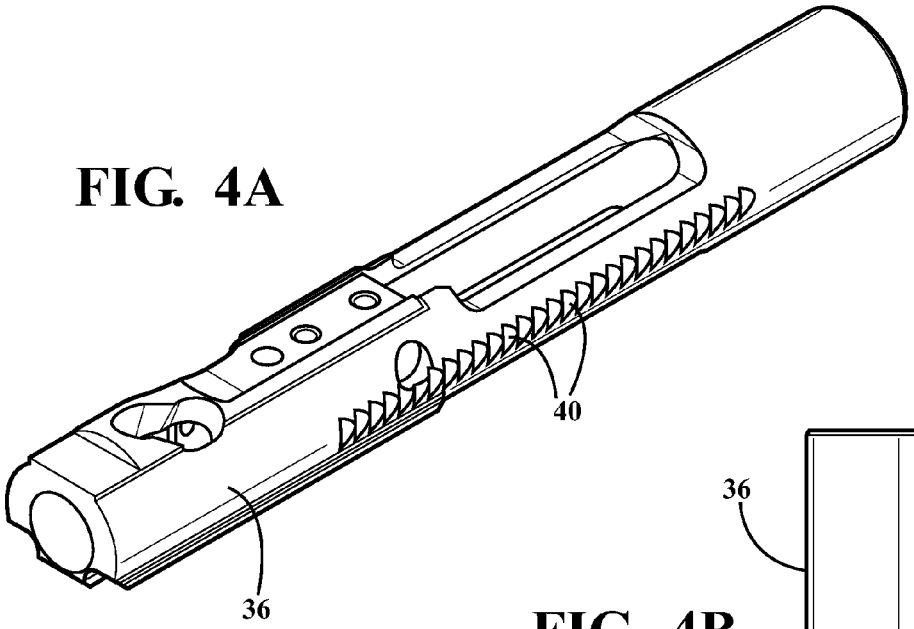
FIG. 4B
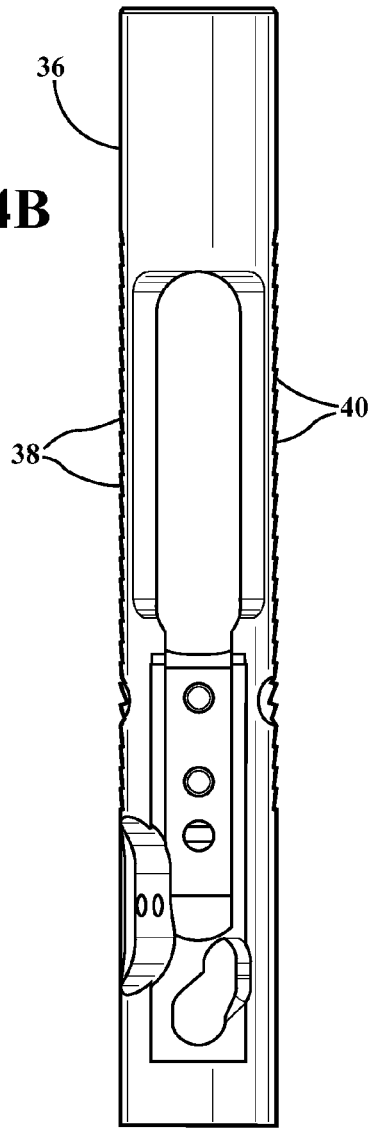
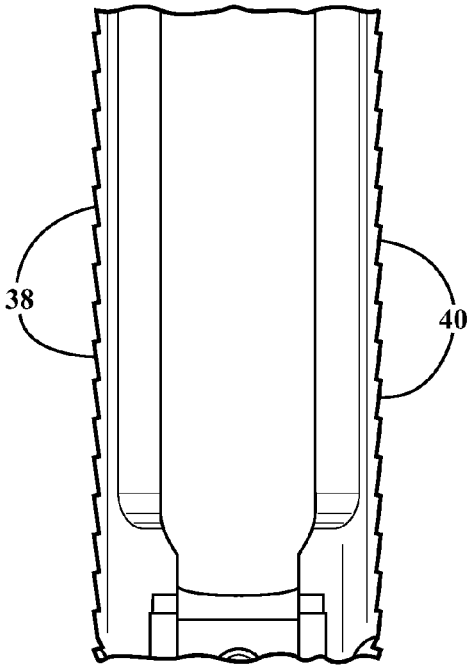
FIG. 4C

MODIFIABLE UPPER RECEIVER FOR M-16/AR15 TYPE FIREARM IN PARTICULAR FOR ADAPTING TO SPECIFIC NEEDS OF RIGHT AND LEFT HANDED SHOOTERS

CROSS REFERENCE TO RELATED APPLICATIONS

This application claims the benefit of U.S. Provisional Application Ser. No. 61/431,248 filed Jan. 10, 2011.

FIELD OF THE INVENTION

The present invention relates generally to a modifiable upper receiver such as belonging to the M-16/AR15 line. More specifically, the present invention teaches a modularized upper receiver which includes any number of replaceable panels applied to either the left or right side of the receiver for establishing varying combinations of forward assist and spent shell deflection and gas deflection, without limitation, for blowback pistol and sub caliber action conversions. The modifiable upper receiver is particularly suited to ambidextrous use and, in the further instance of forward assist notches added to an opposite side of the carrier, prevents the shooter from removing such as the right hand from the pistol grip in order to force feed rounds into the firing chamber.

DESCRIPTION OF THE PRIOR ART

The upper receiver of a firearm such as of the AR-15 or M-16 variety often includes a standardized configuration for placement of such components as the forward assist and ejector, such as typically for facilitating the preferences of a right handed shooter. In an attempt towards modularizing a standard upper receiver for facilitating both left, right and ambidextrous handed users, the VLTOR MUR (Modular Upper Receiver) provides an aluminum forged article incorporating replaceable panels for providing varying combinations of forward assist and ejected casing deflector.

SUMMARY OF THE PRESENT INVENTION

The present invention discloses an upper receiver which is modularized for accepting a variety of left and right handed panels for configuring to specific shooter needs. More specifically, the present invention teaches a modularized upper receiver which includes any number of replaceable panels applied to either the left or right side of the receiver for establishing varying combinations of forward assist and spent shell deflection and gas deflection, without limitation, for blowback pistol and sub caliber action conversions. The modifiable upper receiver is particularly suited to ambidextrous use and, in the further instance of forward assist notches added to an opposite side of the carrier, prevents the shooter from removing such as the right hand from the pistol grip in order to force feed rounds into the firing chamber.

The modifiable upper receiver exhibits a generally elongated body enclosing a reciprocating bolt and action subassembly. At least one panel is dimensioned to secure over a like dimensioned recess defined along the body and includes at least one of forward assist and spent casing ejection feature. In this fashion, the modifiable upper receiver is particularly suited to ambidextrous use, with the body further capable of being modified to at least one of right hand ejection, left hand ejection or left and right hand ejection variants.

Additional features include a bolt carrier incorporated within either of the right handed ejection or the left/right ejection variants, with pluralities of forward assist serrations being provided along opposite sides of the carrier. A first generally smooth faced panel can be secured over a first recess defined along a first side of the body, the forward assist being incorporated into a second panel secured over a second recess defined along a second side of the body. Additional features include either of first and second panels incorporating the spent casing ejection feature which further can be any of a shell deflector, forward assist or gas deflector component.

BRIEF DESCRIPTION OF THE DRAWINGS

Reference will now be made to the attached drawings, when read in combination with the following detailed description, wherein like reference numerals refer to like parts throughout the several views, and in which:

FIGS. 4A-4C illustrate a succession of perspective, top and enlarged top partial views of a bolt carrier incorporated into such as the right handed ejection variant of FIG. 1 and including adaptability for left or right sided forward assist operation;

DETAILED DESCRIPTION OF THE PREFERRED EMBODIMENTS

As previously described, the present invention relates generally to a modifiable upper receiver such as belonging to the M-16/AR15 line and in particular a modularized upper receiver exhibiting any number of replaceable panels applied to either the left or right side of the receiver for establishing varying combinations of forward assist and spent shell deflection (ejection) variants. As will be further described with reference below to the several variants of the invention, the modifiable upper receiver is particularly suited to ambidextrous use and, in the further instance of forward assist notches added to an opposite side of the carrier, prevents the shooter from removing such as the right hand from the pistol grip in order to force feed rounds into the firing chamber.

Figure 7:
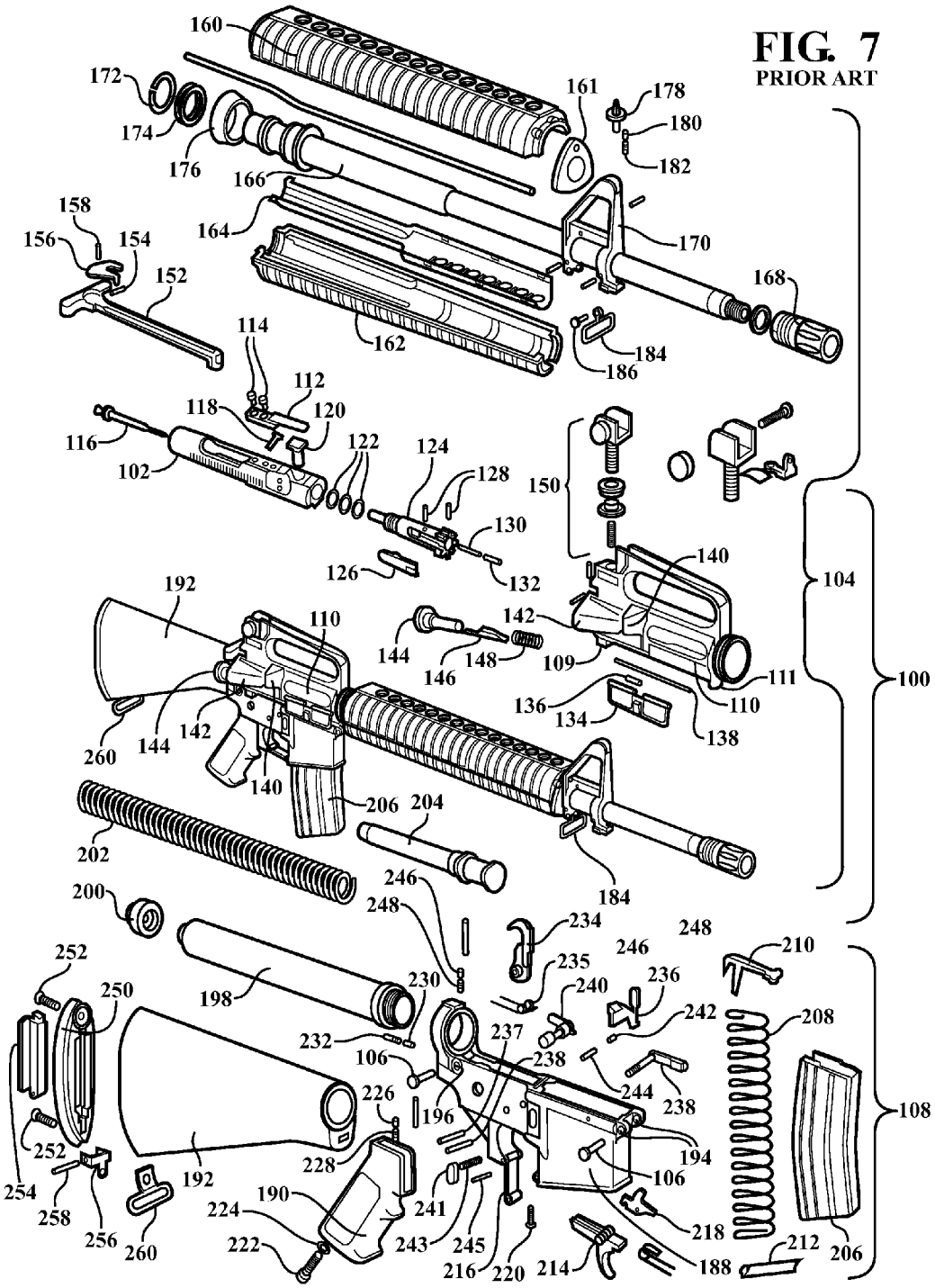
FIG. 7 PRIOR ART
FIG. 7 is a Prior Art exploded illustration of an AR-15 type firearm.

Prior to describing the several embodiments of the invention, FIG. 7 is a Prior Art exploded view, generally at 100, of an AR-15 type firearm and which illustrates the relative positioning of an upper receiver subassembly incorporating a bolt carrier 102 into an overall upper receiver 104 for engagement (via such as take down pins 106) with a lower receiver 108. With reference to the various element callouts provided below, it should be understood that FIG. 5 is intended to be merely illustrative of the relative positioning of the upper receiver action subassembly relative to the remaining components of the upper and lower receiver and is meant to supplement and, by no means, replace or otherwise interpret the specific components of the modular receivers depicted in the variants of FIGS. 1-6.

An upper receiver housing 110 with underside takedown pin apertures 109 and 111 is utilized within the overall upper receiver 104 for incorporating the bolt carrier 102. Additional known features include bolt carrier key 112 and key screws 114. Firing pin 116 is supported in a rearward end inserting fashion within the bolt carrier 102 via retaining pin 118. Cam pin 120 seats within a top of the bolt carrier 102 forwardly of the bolt carrier key 112.

Mounting within a forward inserting end are a plurality of bolt gas rings 122. A reciprocating bolt 124 mounts an extractor 126 via pins 128. An ejection spring 130 and ejector 132 mounts within a forward end of the bolt 124 which is in turn seated within the carrier 102. Additional features associated with the conventional upper receiver housing 110 include ejection port cover 134, spring 136 and cover pin 138.

A deflector component 140 is integrally formed in the housing 110 as is a forward assist configuration 142 which in turn seats a forward assist plunger 144 and associated pawl 146 and spring 148. Further generally depicted is a rear sight assembly 150 engageable with the upper receiver housing 110. A charging handle 152 with associated latch spring 154, latch 156 and roll pin 158 is also provided for facilitating installation of the bolt carrier 102 within the upper receiver housing 110.

The above recited conventional features generally identify those components of a conventional M16/AR-15 type firearm with which the modular upper receivers depicted throughout FIGS. 1-3, 5 and 6 can be substituted, the bolt carrier of FIGS. 4A-4C further capable of substituting the conventional carrier 102 of FIG. 7.

For purposes of completeness in description, additional Prior Art components associated with the upper receiver 104 shown in FIG. 7 include such as thermo set hand guards 160 and 162, with forward end hand guard cap 161 and inner heat shield/liner 164 which sandwich around barrel 166 with forward flash suppressor 168, integrally formed front sight 170 as well as rear secured hand guard snap ring 172, weld spring 174 and delta ring 176. A front sight post 178 with associated sight detent 180 and detent spring 182 mounts to the front sight 170. A front sling swivel 184 attaches to an underside of the barrel via a swivel rivet 186.

Additional Prior Art components associated with the conventional lower receiver assembly 108 include the lower receiver magazine and trigger mounting housing 188, assembleable grip 190 and butt stock 192. The lower housing 188 includes integrally configured locations 194 and 196 which receive the takedown pins 106 in order to mount the upper receiver housing 110 (as substituted by the various upper receivers of FIGS. 1-6).

Other known features, provided again for purposes of completeness of description, include receiver extension 198 seating along the top of the lower housing 188 and including a rear located butt cap spacer 200 for mounting the butt stock 192. An action spring 202 seats within the extension 198, a buffer assembly 204 seating within a forward end of the extension 198 in biasing contact with a forward inserted end of the spring 202. Other known illustrated features include magazine 206 internally seating a magazine spring 208 and upper displaceable follower 210 in biasing fashion relative to a floor plate 212 mounted to a bottom of the magazine 206 and which, upon assembly within an open receiving bottom location of the lower housing 188, feeds pre-loaded cartridges into the upper housing 110 as further depicted in the complete assembly subset illustration of FIG. 7.

A trigger 214 and associated trigger guard 216 are mounted to the underside of the lower housing 188 along with disconnector 218 and disconnector spring 220. The pistol grip 190 is held in place by a pistol grip screw 222 and associated lock washer 224. A safety detent 226 and associated detent spring 228 is provided along with a take down pin detent 230 and further associated spring 232 in proximity of the grip 190 and lower housing 188.

For purposes of completeness of description, other components associated with the conventional lower housing include hammer 234 and associated spring 235, bolt catch 236, magazine catch 238, safety selector lever 240, bolt catch plunger 242 and associated spring 244. Other elements shown which are incorporated into the lower housing 188 include each of a hammer pin 237, trigger pin 239, magazine release button 241 and catch spring 243 and trigger guard pivot roll pin 245.

Additional components include buffer retainer 246 and associated spring 248 associated with the buffer assembly 204. Finally, a butt plate 250 is secured to a rear of the butt stock 192 via screws 252, with an access door 254 mounted to the butt plate 250 in pivotally opened fashion via an access door hinge 256 and associated hinge pin 258. A rear sling loop 260 is mounted to the underside of the butt stock 192 and, in combination with the front swivel 184 (see again assembly view in FIG. 7) provides engaging support to opposite ends of a strap (not shown).

Aside from the representative Prior Art illustration of FIG. 7, it is understood that any of an M16, AR-15, M4 or other similar rifle is available in a wide range of configurations ranging from short carbine-length models with features such as adjustable length stocks and optical sights to heavy barrel models. Due to the rifle's modular design, one upper receiver can quickly and easily be substituted for another, with various aftermarket receivers incorporating barrels of different weights, lengths and calibers.

Figure 1A:
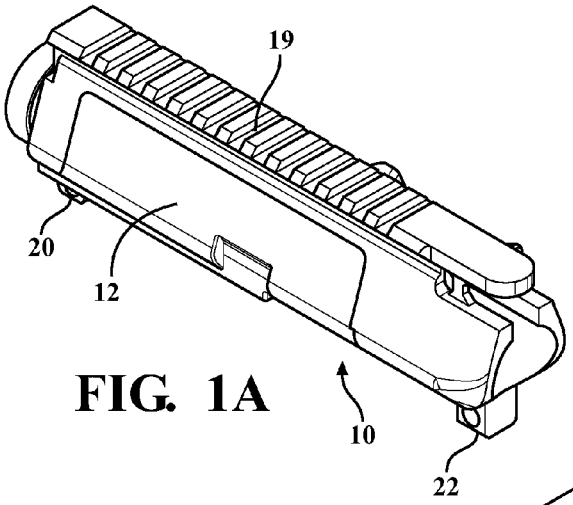
FIGS. 1A-1E present a series of first and second perspective, top, and first and second side illustrations of a right handed ejection variant of an upper receiver according to a first variant of the present inventions.
Figure 1B:
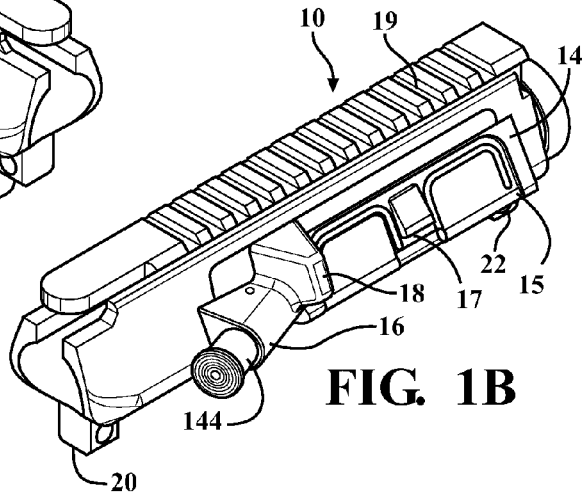
Figure 1C:
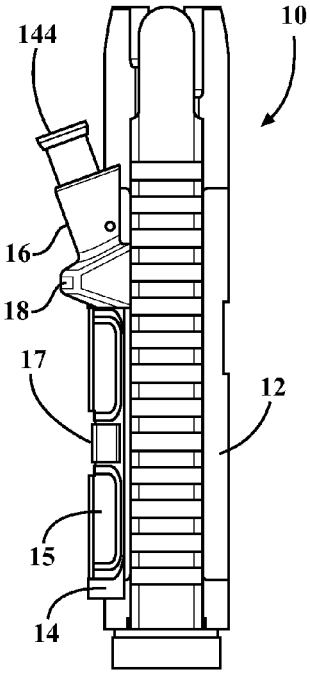
Figure 1D:
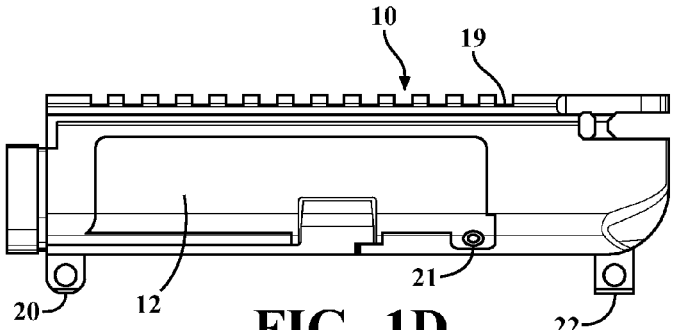
Figure 1E:
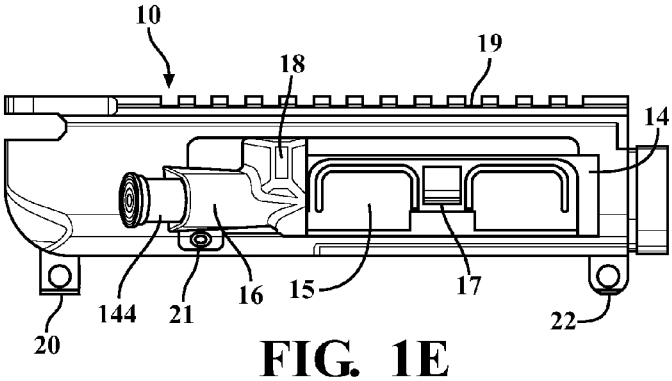
Figure 2A:
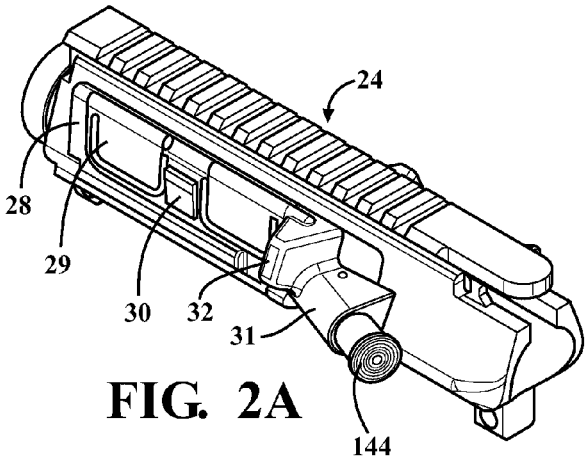
FIGS. 2A-2E present a series of first and second perspective, top and first and second side illustrations of a left handed ejection variant of an upper receiver according to a second variant.
Figure 2B:
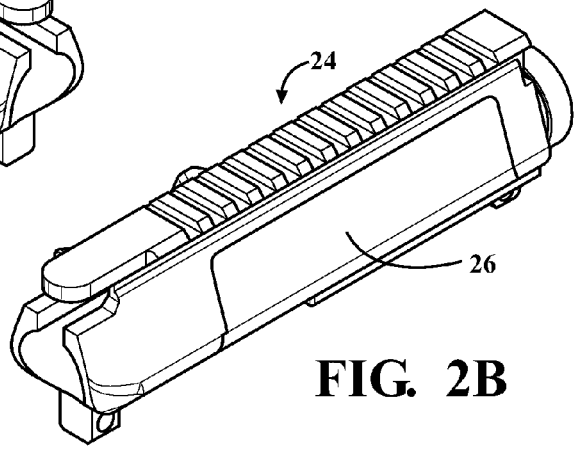
Figure 2C:
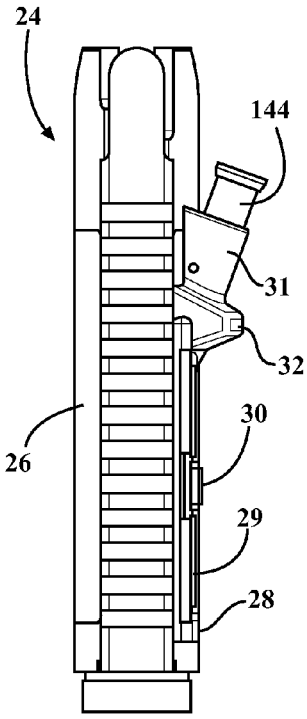
Figure 2D:
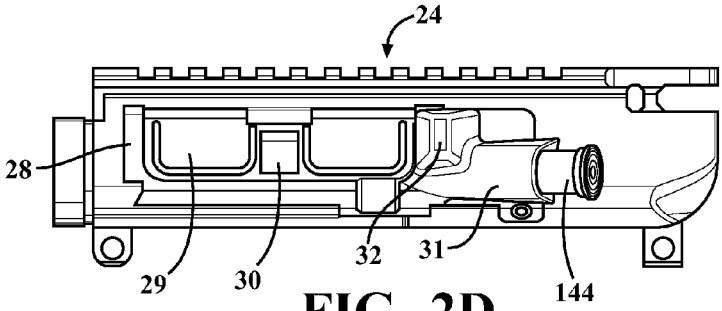
Figure 2E:
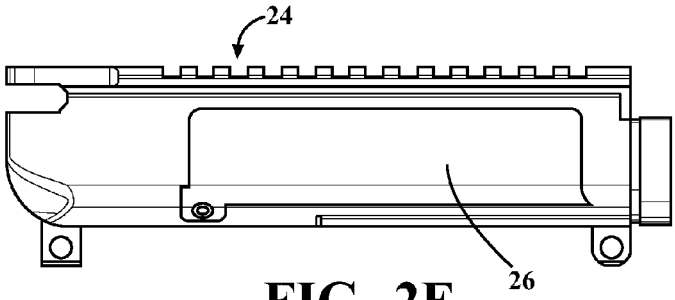
Figure 3A:
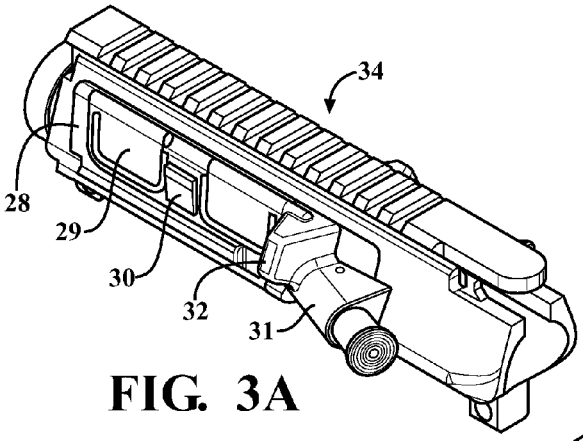
FIGS. 3A-3E are a yet further series of first and second perspective, top and first and second side illustrations of an upper receiver in which varying combinations of engageable panels establish left or right handed ejection variants.
Figure 3B:
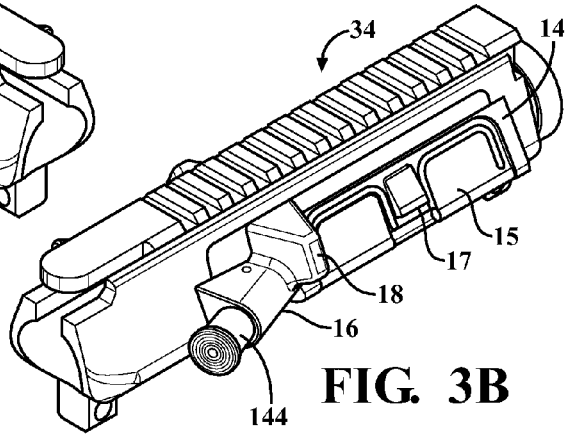
Figure 3C:
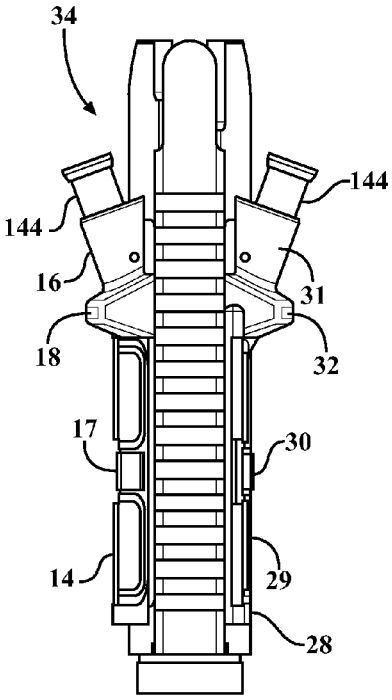
Figure 3D:
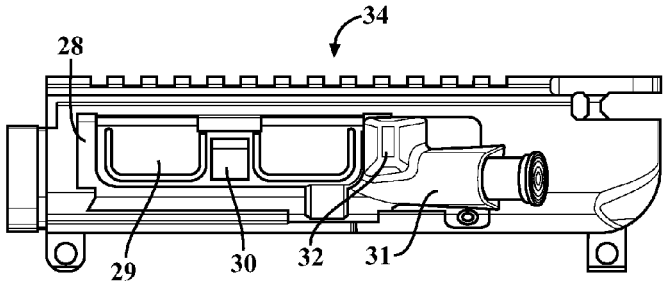
Figure 3E:
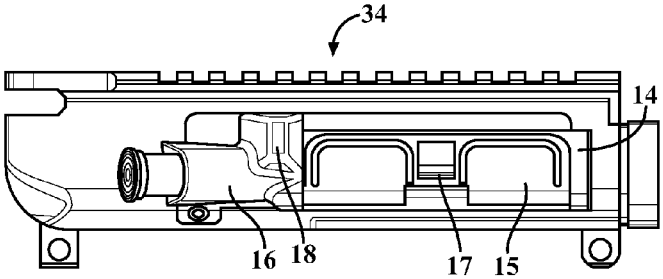
Figure 5A:
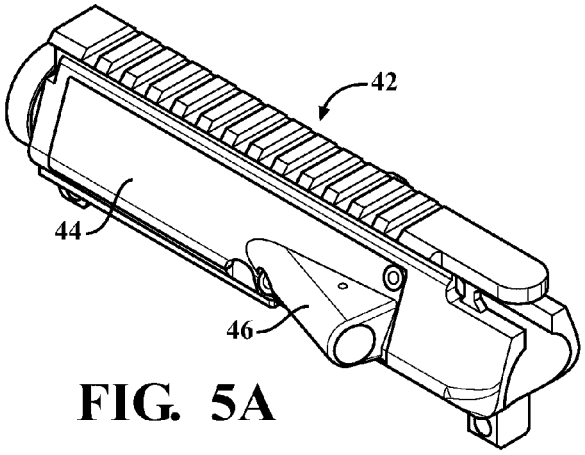
FIGS. 5A-5E present a series of first and second perspective, top and first and second side illustrations of a further right ejection, left hand bolt assist variant.
Figure 5B:
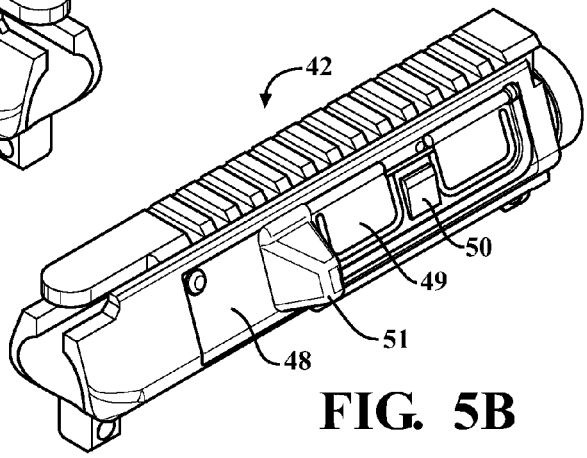
Figure 5C:
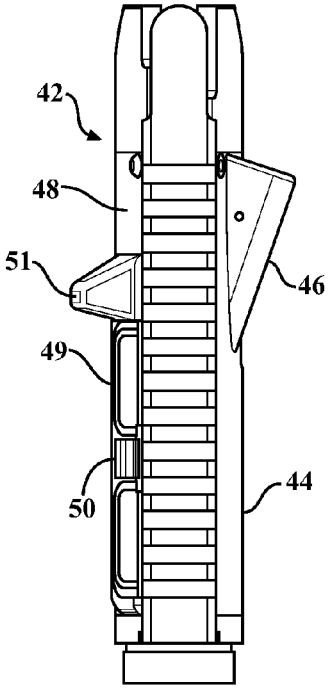
Figure 5D:
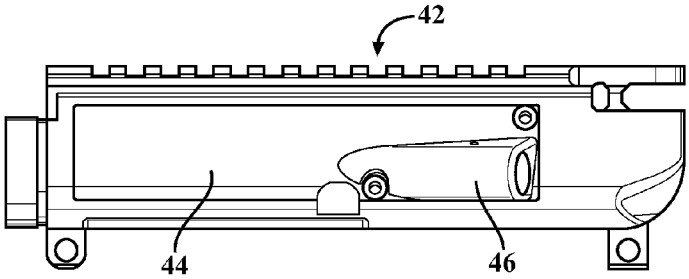
Figure 5E:
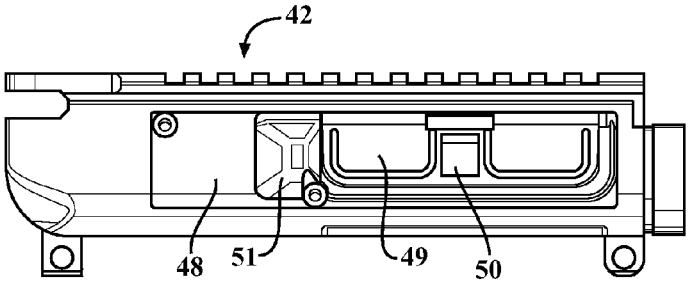
Figure 6A:
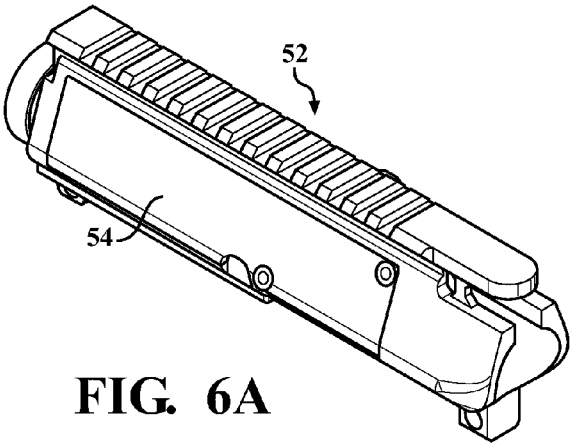
FIGS. 6A-6E present a series of first and second perspective, top and first and second side illustrations of a right hand ejection variant with gas deflector for use with blowback action caliber conversions.
Figure 6B:
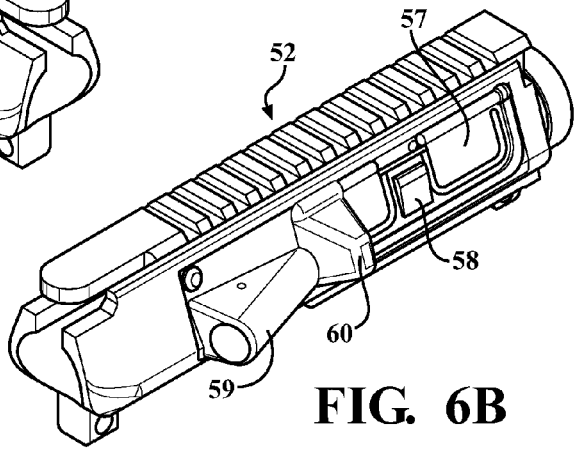
Figure 6C:
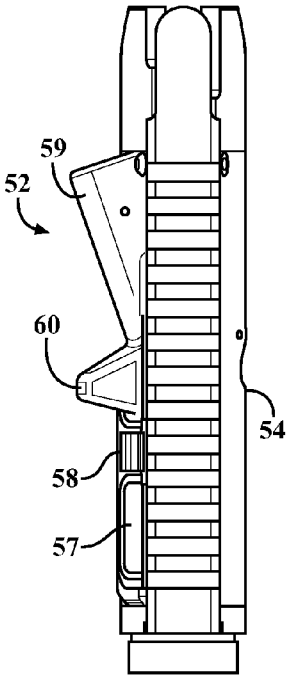
Figure 6D:
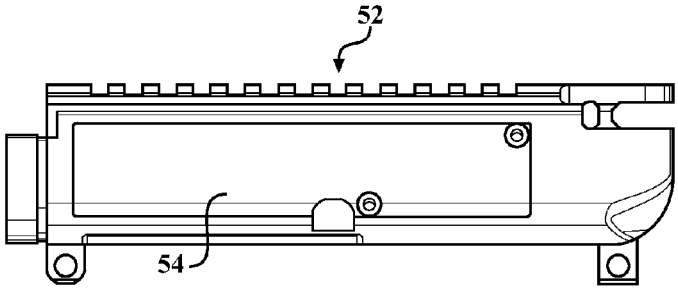
Figure 6E:
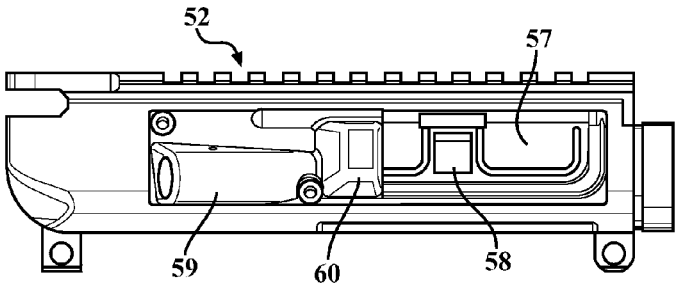

Having provided a basic description of an existing M16/AR-15 type rifle shown in FIG. 7, and now referring initially to FIGS. 1A-1E, a series of illustrations (in succession depicting a first perspective FIG. 1A, a second rotated perspective FIG. 1B, a top view FIG. 1C and first (FIG. 1D) and second (FIG. 1E) rotated side views) are collectively presented of a right handed ejection variant of an upper receiver 10 according to a first variant. The receiver subassembly 10 again substitutes for the Prior Art components previously described by bolt carrier 102 and associated upper receiver housing 110 with associated components 112-148 and exhibits an elongated, generally cylindrical, outer shell (typically constructed of a durable grade steel and/or aluminum). As further depicted in the prior art illustration of FIG. 7, the action subassembly (again referencing upper receiver housing 110 and associated elements) defines a component of the upper receiver and, without limitation, again incorporates a number of components by example including the bolt/carrier 102, extractor 126, firing pin 116, charging handle 152 and associated components.

Referring again to FIGS. 1A-1E, the upper receiver 10 of the present invention exhibits a first arrangement of panels 12 and 14 which secure over associated recesses defined along the receiver body. As depicted, a generally smooth panel 12 exhibiting a rectangular profile and a determined cross sectional curvature or bend is provided and is dimensioned to secure over a like dimensioned opening depicted on the left side of the receiver subassembly.

A further panel 14 incorporates a combination of dust cover 15 with locking tab 17, a forward assist 16 (supporting such as a conventional forward assist plunger 144 component as shown in FIG. 7) and ejection port/deflector 18, these features being integrally configured into the panel architecture. In contrast to the Prior Art upper receiver depicted in FIG. 7 and which are created from standardized forgings, the modular receiver 10 provides a first possible arrangement of replacement panels for enhancing user versatility.

It is again understood that the modularized upper receiver 10 with panel arrangements 12 and 14 substitute for the Prior Art upper receiver shown by example at 110 in FIG. 7 and such that the original working components of the upper receiver, including the bolt carrier and additional action assembly components, can be retained for use with the modular receiver 10. It is also envisioned that additional operating components can be included with any suitably configured and substitute upper receiver and which can replace those associated with the original upper receiver.

The panels 12 and 14 are secured to the sides of the modular and replacement upper receiver 10 in any fashion such as including the provision of screws or like fasteners (see as depicted at 21 in FIGS. 1D and E) further exhibit a suitable arrangement of perimeter located tabs or the like which mate with opposing and inner perimeter aligned slots defined in the upper receiver 10.

A mounting rail 19, such as commercially known as a Picatinny style or other suitable rail configuration, exhibits a dovetail shape profile in cross section, is provided in extending fashion atop the upper receiver 10 and, upon installing the receiver 10 as a replacement component into a suitable firearm (such as again replacing the upper receiver 110 and internally supported bolt carrier 102 with related components of the AR-15 style firearm depicted in the Prior Art view of FIG. 7), the top rail 19 facilitates the installation of any suitable accessory exhibiting a suitably configured mating base with underside mating dovetail recess profile and associated tightening screws. Also illustrated are a pair of underside located and width extending mounting supports 20 and 22, these exhibiting widthwise extending apertures which, upon aligning the upper receiver 10 in substitution for the Prior Art receiver 110 (again FIG. 7) relative to the lower receiver housing 188, facilitates installation by application of the takedown pins 106.

Referring to FIGS. 2A-2E, a similar series of perspective, top and side view illustrations are provided of a left handed ejection variant 24 of upper receiver according to a second variant, and by which a panel 26 corresponds to that depicted at 12 in FIG. 1, with the exception being that it is secured to a right side located opening in the receiver housing. A further panel 28 is located on the left side of the receiver 24 and corresponds to the right side located panel 14 of FIG. 1, again including dust cover 29 with locking tab 30, a forward assist 31 and ejection port/deflector 32 features. Identical features to that depicted in the initial variant of FIGS. 1A-1E, again including a top Picatinny style rail 19, as well as bottom mounting locations 20 and 22, are again referenced but are not separately numbered for purposes of ease and clarify of illustration.

Referring to FIGS. 3A-3E, a further series of illustrations depict an upper receiver 34 in which a further varying combination of engageable panels including those previously depicted at 14 in the variant of FIG. 1 and further at 28 in FIG. 2 are provided together to establish both left and right hand ejection (this further contemplating a dual forward assist mechanism again including plungers 144). This sub-combination further envisions both shell casing ejection (and optionally shield deflection as well as gas deflection for blowback pistol and sub caliber ammunition) features incorporated into either side of the receiver 34. A left handed bolt or bolt and carrier group is also required for actual left ejection and typically, but not necessarily, mirrors a corresponding right handed bolt or bolt and carrier group.

FIGS. 4A-4C provide a series of perspective, top and top enlarged partial views of a right handed bolt carrier component identified at 36. Pluralities of forward assist serrations 38 and 40 can be provided along each of opposite sides of the bolt carrier and which is incorporated within either of the right handed variant 10 of FIG. 1, the left handed variant 24 of FIG. 2, or the left/right forward assist variant 34 of FIG. 3. The individual arrangement of serrations 38 and 40 prevent a user from removing the right hand from the pistol grip in order to force feed rounds into the firing chamber (reference again being made to the Prior Art illustration of FIG. 7).

FIGS. 5A-5E present a further series of first and second perspective, top and first and second side illustrations of a further right ejection, left hand bolt assist variant of upper receiver depicted generally at 42 and which includes a left side attachable panel 44 integrating a forward assist 46 architecture (such as for seating the forward assist plunger 144), a corresponding right side attachable panel 48 further incorporating a dust cover 49 with locking tab 50 and an ejection port/deflector profile 51 designed into its corresponding architecture. FIGS. 6A-6E present a yet further series of first and second perspective, top and first and second side illustrations of a right hand ejection variant with gas deflector for use with blowback action caliber conversions, see upper receiver 52 which is generally similar to that depicted in the initial disclosed variant 10 of FIG. 1 and which includes a further collection of left side closure panel 54 and right side panel 56 including dust cover 57, dust cover locking mechanism 58, forward assist 59 and ejection port/deflector profile 60.

It is further envisioned that all of the panels may exhibit an ejection port feature of some type and may include, without limitation, any of a shell deflector, forward assist or gas deflector, such as again for assisting in blowback action caliber conversions. Yet additional features may include multiple cutouts/notches associated with a positive locking mechanism incorporated in conjunction with the hand guard.

The modifiable upper receiver provides the user with the ability to be employed in an ambidextrous use fashion. It is further envisioned that the panels can be provided in a variety of configurations, colors and materials, with polymer being one non-limiting example.

Additional variants envision incorporation of a flat panel, such as according to any of the previously described examples, and which exhibits a slot only configured to allow for spent casing ejection, such panel dispensing with any or all of the deflector, dust cover or forward assist elements. Such a redesign configuration is useful for match rifles where protection from debris isn't required and the forcing of a stubborn round into a chamber isn't desired (such as which could result in barrel damage), and further where traditional one o'clock to three o'clock deflection further isn't necessary (such as where shell deflectors aid in ejecting shells to the right and forward). Such features safeguard shooters who shoulder a right hand eject firearm on their left shoulder and, without a deflector in place, may result in the spent casing ejecting right and back, resulting in potential facial injury of the user.

Having described our invention, other additional preferred embodiments will become apparent to those skilled in the art to which it pertains and without deviating from the scope of the appended claims.

We claim:

1. A modifiable upper receiver for a fire arm, comprising:

an elongated and three dimensional body enclosing a reciprocating bolt and action subassembly;

a first recess defined along a first side and a second recess defined along a second side of said body in communication with said bolt and action assembly; and a pair of attachable panels dimensioned to secure over like dimensioned recesses defined along said first and second sides of said body, a first of said panels exhibiting a generally smooth face and securing to said body over said first recess, a second of said panels incorporating each of a spent casing ejection feature and a forward assist feature and securing to said body over said second recess such that said modifiable upper receiver is suited for use by both right and left handed shooters, the forward assist feature having a forward assist plunger integrated into said second panel.

2. The receiver as described in claim 1, said bolt and action subassembly further comprising a bolt carrier, pluralities of forward assist serrations being provided along opposite sides of said carrier.

3. A substitute upper receiver for integration into an existing fire arm, said receiver comprising:

an elongated and three dimensional body enclosing a reciprocating bolt and action subassembly;

a closed perimeter window defined along each of first and second extending sides of said body, each of said extending sides defining a dimensioned recess;

first and second panels each dimensioned to secure over the dimensioned recesses defined along said body, and configured for supporting each of a spent casing ejection feature and a forward assist feature associated with said action subassembly, said first panel having a smooth exterior surface and being secured over the first dimensioned recess defined along the first extending side of said body, said forward assist feature incorporated into said second panel including a plunger, said second panel being secured over the second dimensioned recess defined along the second extending side of said body; and said modifiable upper receiver being suited for use by both right and left handed shooters.

4. The receiver as described in claim 3, said bolt and action subassembly further comprising a bolt carrier, pluralities of forward assist serrations being provided along opposite sides of said carrier.

5. An assembly for modifying a firearm for use by both right and left handed shooters, comprising:

an upper receiver having an elongated and three dimensional body enclosing a reciprocating bolt and action subassembly, said bolt and action subassembly further comprising a bolt carrier, pluralities of forward assist serrations being provided along opposite sides of said carrier;

a closed perimeter window defined along each of first and second extending sides of said body, each of said extending sides defining a dimensioned recess in communication with said action subassembly; and first and second panels each dimensioned to secure over the dimensioned recesses defined along said body, said first panel being secured over the first dimensioned recess defined along the first extending side of said body and comprising a generally smooth exterior surface, said second panel being secured over the second dimensioned recess defined along the second extending side of said body and comprising a forward assist feature operable in association with said action subassembly, a forward assist plunger being incorporated into said second panel.

* * * * *